United States Patent [19]

Swenson et al.

[11] Patent Number: 4,537,366

[45] Date of Patent: Aug. 27, 1985

[54] ROLL CONTAINER

[76] Inventors: Kirk A. Swenson, 6516 Longview Beach Rd.; Robert E. Swenson, 1932 Utica Pike, both of Jeffersonville, Ind. 47130

[21] Appl. No.: 513,455

[22] Filed: Jul. 13, 1983

[51] Int. Cl.[3] ..... B65H 49/18

[52] U.S. Cl. ..... 242/137; 206/226

[58] Field of Search ..... 242/96, 55.53, 55.2, 242/137; 206/226, 225, 214, 397, 389, 371, 409; 434/411, 412, 415

[56] References Cited

U.S. PATENT DOCUMENTS

| | | | |
|---|---|---|---|
| Re. 8,875 | 9/1879 | Cushman | 242/68 |
| 878,823 | 2/1908 | McNaughton | 206/226 |
| 1,099,766 | 6/1914 | Prince | 242/137 |
| 2,613,040 | 10/1952 | Lewis | 242/67.3 R |

FOREIGN PATENT DOCUMENTS

| | | | |
|---|---|---|---|
| 360050 | 11/1931 | United Kingdom | 206/226 |

*Primary Examiner*—Stephen Marcus
*Assistant Examiner*—Leo J. Peters
*Attorney, Agent, or Firm*—Jon C. Winger

[57] ABSTRACT

A drawing toy having a housing and a web of material upon which a child can draw, color or mark. The housing includes a generally cylindrically shaped shell formed of two generally semi-cylindrical halfs. A hollow spindle having the web of material wound thereon it is located in the shell in substantial coaxial relationship with one end of the spindle projecting from one end of the cylindrical shell. A cap is removably attached to the projecting end of the spindle so that as the cap is turned, the spindle is caused to rotate about the longitudinal axes of the shell to unwind the web from or rewind the web on the spindle. A slot is formed in the shell through which the web of material moves as the web is unwound and re-wound on the spindle.

12 Claims, 3 Drawing Figures

10
12
52
16
20
14
46
18
58
22
56

44
16
14
46
58
56
34
32
40
26
36
24
20
50
48
68
42
28
22
55
30
54
38
70
12
18
62
60
64

ROLL CONTAINER

BACKGROUND OF THE INVENTION

The present invention relates to devices for containing a scroll, and more particularly to a childs drawing toy for storing a rolled web of material, unwinding selected lengths of the material web for use and rewinding the material web for storage.

SUMMARY OF THE INVENTION

The present invention is particularly adapted for unwinding a web of paper upon which a child can draw or color pictures and rewinding the web of paper for storage.

Traditional coloring and drawing books can quickly and easily become dog-earred and otherwise mutulated. Typically, when opened for use, they are folded back over the bound edge which prevents the pages from laying flat, and which eventually causes the binding to break leaving loose sheets.

Scroll holding devices for dispensing a web of material upon which a child can draw and color pictures are known. Such devices include a box having a web dispensing roll located in spaced apart, parallel relationship to a web take-up roll and a window opening between the rolls. The child using the device can draw or color on that portion of the web between the rollers exhibited in the window.

An object of the present invention is to provide a compact drawing toy for unwinding a length of web material from a web roll, for example, paper upon which a child can draw, color pictures, or play games and rewinding the web for storage on the same web roll.

Another object of the present invention is to provide a drawing toy for unwinding and rewinding a web of material which is readily refillable with a new roll when a preceding web has been used up.

A further object of the present invention is to provide a drawing toy for unwinding and rewinding a web of material on the same web roll including a place for storing drawing and coloring pencils.

It is still another object of the present invention to provide a drawing toy of the class described including a device for sharpening drawing and coloring pencils.

More particularly, the present invention provides a drawing toy for unwinding a web of material for use and rewinding the web for storage comprising a first generally semi-cylindrically shaped shell, a second generally semi-cylindrically shaped shell adapted to be selectively located in registered concavely facing relationship to the first shell so that the first and second shells cooperate to form a generally cylindrically shaped housing; a spindle having a length longer than the length of the housing adapted to be removably located within the housing for rotational movement about the longitudinal axis of the housing and having one end projecting from an end of the housing; a web of material spirally wound on the spindle, the width of the web being somewhat less than the length of the housing, and the web being asymetrically located between the ends of the spindle; means defining a slot through the arcuate wall of the housing generally longitudinally of the housing, the slot having a length generally equal to the width of the web and a width generally equal to the thickness of the web; and, a cap attached to the projecting end of the spindle so that the spindle is rotatably movable with the cap.

BRIEF DESCRIPTION OF THE DRAWINGS

A better understanding of the present invention will be had by reference to the following description in conjunction with the accompanying drawings wherein like numerals refer to like parts and in which:

FIG. 2 is a perspective exploded view of the device of FIG. 1; and,

DETAILED DESCRIPTION OF THE PREFERRED EMBODIMENT

Figures 1, 3:
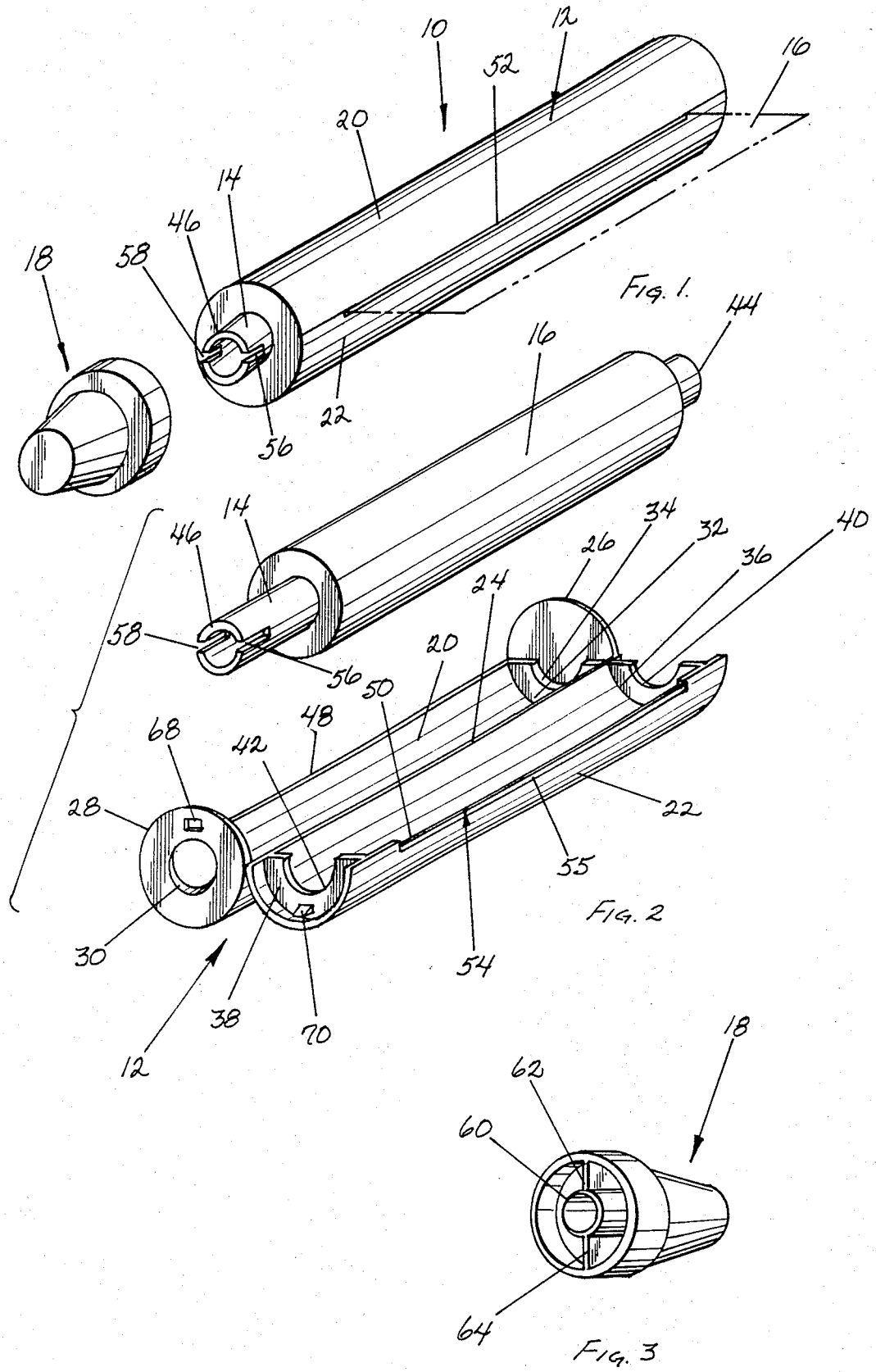
FIG. 1 is a perspective view of a device for storing and dispensing a web of material embodying the present invention.
FIG. 3 is a perspective view of one component of the device of FIG. 1.

The Figures depict a childs drawing toy, generally denoted as the numeral 10, having the features of the present invention.

The drawing toy 10 includes a generally cylindrically shaped housing 12, a hollow spindle 14 with a web of material 16 wound thereon adapted to be installed within the housing 12, and an end cap 18 adapted to be removably attached to one end of the spindle 14.

As can be best seen in FIG. 2, the housing 12 includes two generally semi-cylindrical shells 20 and 22 which when disposed in mutually concavely facing closed relationship form the housing 12 as shown in FIG. 1. As shown, the first and second semi-cylindrical shells 20 and 22, respectively, are interconnected by hinge means 24. The hinge means 24 interconnects one longitudinal edge of the first shell 20 to one longitudinal edge of the second shell 22. Preferably, the hinge means 24 is integral with the first and second shells and is what is commonly referred to as a lining hinge. The hinge means 24 allows the first and second shells to be pivotally moved, relative to each other, between their concavely facing closed position (shown in FIG. 1) and an open position out of concavely facing relationship (shown in FIG. 2).

With continued reference to FIG. 2, the first semi-cylindrical shell 20 includes a generally planar, generally cylindrically shaped end wall 26 at one end 20, and an annular end wall 28 at the other end. A bore 30 defined by the annular wall 28 has a diameter generally equal to the diameter of the spindle 14 and is coaxial with the longitudinal axes of the first shell 20. Preferably, the circular end wall 26 and annular end wall 28 are integrally formed with the first shell 20. A spindle support flange 32 is located near the circular end wall 26 to support one end of the spindle 14. The spindle support flange 32 is shown defining an arcuate ledge 34 having a radius generally equal to the radius of the spindle 14 with the radius being generally coaxial with the bore 30 of the annular end wall 28. Preferably the spindle support flange 32 is integrally formed with the first shell 20.

The second semi-cylindrical shell 22 is open at both of its ends and includes a pair of flanges 36 and 38. The first flange 36 is located near the open end of the second shell 22 which is adjacent to the end of the first shell 20 having the circular end wall 26, and the second flange 38 is located near the other open end of the second shell 22 which is adjacent to the end of the first shell 20 having the annular end wall 28. The first flange 36 defines an arcuate ledge 40 having a radius generally equal to the radius of the spindle 14 with the radius being generally coaxial with the longitudinal axis of the second shell 22. Similarly, the second flange 38 defines an arcuate ledge 42 having a radius generally equal to the radius of the spindle 14 with the radius being generally coaxial with the longitudinal axis of the second shell 22. The space between the first and second flanges 36 and 38, longitudinally of the second shell 22, is generally equal to the width of the web 16 and less than the distance between circular end wall 26 and annular end wall 30 of the first shell 20. Preferably, the first and second flanges 36 and 38 are integrally formed with the second shell 22.

The hollow spindle 14 is longer than the length of the housing 12 and is adapted to be coaxially disposed within the housing 12. Toward this end, the spindle 14 is located generally coaxially in the first shell 20 with one spindle end 44 in juxtaposition to the circular end wall 26 and cradled in the arcuate ledge 34 and the other spindle end 46 received through the bore 30 of the annular end wall 28 and projecting a distance past the annular end wall 28.

The width of the material web 16 is somewhat less than the length of the first shell 20. The web 16 is spirally wound upon the spindle 14 and is asymetrically located between the spindle ends 44 and 46. The wound web 16 is to be located between the circular end wall 26 and annular end wall 28 of the first shell 20.

With the spindle 14 and wound web 16 located in the first shell 20, the first and second shells 20 and 22 are pivoted about the hinge means 24 into mutually concavely facing closed relationship. When in this closed position, the first and second flanges 36 and 38 of the second shell 22 are located at opposite ends of the wound web 16 caging it therebetween to limit movement of the spindle and web in a longitudinal direction of the housing 12. Further, when the shells are in this closed position the arcuate ledge 40 of the first flange 36 is located in concavely facing relationship to the arcuate ledge 34 of the spindle support flange 32 of the first shell 20 and cooperates therewith to form a journal supporting the spindle end 44. The circular end wall 26 of the first shell 20 closes the one open end of the second shell 22 and the annular end wall 28 of the first shell 20 closes the other open end of the second shell 22.

With reference to FIG. 1, when the first and second shells 20 and 22 are in the closed position forming the housing 12, the free longitudinal edges 48 and 50 of the shells 20 and 22, respectively, cooperate to define a longitudinal slot 52. The slot 52 is generally as long as the width of the web 16 and is generally as wide as the thickness of the web 16. As illustrated in FIG. 2, one of the longitudinal edges of the shells, for example, longitudinal edge 50 of shell 22 is formed with a longitudinally extending notch 54. When the shells 20 and 22 are in the closed position shown in FIG. 1, the longitudinal edge 48 of shell 20 lays in juxtaposition along the open side of the notch 54 and cooperates therewith to define the slot 52. The free end of the web 16 is slidably received through the slot 52 so that it can be dispensed from the housing 12 for use and retreived through the slot 52 for storage. In addition, one longitudinal edge of the slot 52, preferably that longitudinal edge defined by the notch 54, is thinner than the other longitudinal edge defined by the longitudinal edge 48 of the shell 20. This can be accomplished by removing some of the material from the convex surface of the second shell 22 along the longitudinal side of the notch 54 as denoted by the numeral 55. Thus, one longitudinal edge of the slot 52 is relieved from the other longitudinal edge of the slot 52. The relief provides clearance for the portion of the web 16 extending through the slot 52 as it is being unwound from and rewound on the spindle 14 and prevents the web 16 from binding in the slot 52.

With reference to FIGS. 1 to 3, the end cap 18 is adapted to be removably attached to the open end 46 of the spindle 14 so that as the cap 18 is turned the spindle 14 will turn with it to unwind or rewind portions of the web 16 from the spindle 14 through the slot 52. The cap 18 is removable from the spindle end 46 to gain access to the interior of the hollow spindle 14. Toward this end, the spindle end 46 is illustrated as being formed with two notches 56 and 58 diametrically spaced from each other and open at the spindle end 46. The cap 18 is formed with a collar 60 having an outside diameter generally equal to the inside diameter of the spindle 14 and which is coaxially received in the hollow end 46 of the spindle end 46. While it has been found that the friction between the outside diameter of the cap collar 60 and inside wall surface of the hollow spindle is sufficient to provide for the turning of the spindle with the cap 18, in the illustration of FIG. 3, two ribs 62 and 64 are formed on the circular wall 60 diametrically spaced from each other and radially extending outwardly of the circular wall 60. Each of the ribs 62 and 64 is adapted to be received in a different one of the notches 56 and 58 of the spindle end 46 to provide a physical connection between the cap 18 and spindle 14.

Preferably, the housing is fabricated of a high impact plastic material and is injected molded.

In order to shape the first and second shells 20 and 22 in the closed position, a latch, generally denoted as the numeral 66 is provided for selectively latching the shells together. As can be best seen in FIG. 2, the latch comprises a slit 68 formed in the annular wall 28 of the shell 20 and a lip 70 formed on the second flange 38 of the shell 22. When the shells 20 and 22 are in the closed position concavely facing each other, the lip 70 is received in the slit 68, thus, preventing the shells 20 and 22 from pivoting about the hinge 24 to the open position. To open the housing 12, the shell 22 is distorted by pressing inwardly on opposite sides. In so doing, the lip 70 moves out of the slit 68 and the shells 20 and 22 can be pivoted to the open position.

The childs drawing toy 10 of the present invention provides a number of advantages over the drawing devices known to us. The present invention provides a complete drawing toy including the sheet of material upon which to draw, a place for storage of the drawing pencils and a place for storing the sheet of drawing material. Further, the web of drawing material provides a continuous mural-type surface upon which to draw and color. This allows a continuous game, story or these to be exhibited without having to turn pages be viewed and worked on through a restricted space such as a window opening. In addition, sections of the web of drawing material can be cut-off for display without adversely effecting the operation of the drawing toy.

The foregoing detailed description is given primarily for clearness of understanding and no unnecessary limitations are to be understood therefrom for modifications will become obvious to those skilled in the art upon reading this disclosure and may be made without departing from the sprit of the invention or scope of the appended claims.

What is claimed is:

1. A roller container comprising:

a first generally semi-cylindrically shaped shell having a generally circularly shaped end wall at one of its ends and an annularly shaped wall at the opposite one of its ends;

a second generally semi-cylindrically shaped shell adapted to be selectively located in registered concavely facing relationship to the first shell so that the first and second shells cooperate to form a generally cylindrically shaped housing;

a spindle having a length substantially longer than the length of the housing adapted to be removable located within the housing for rotational movement about the longitudinal axis of the housing and having one end projecting from an end of the housing through the bore defined by the annular end wall of the first shell, the spindle is hollow with the projecting end being open and adapted to receive drawing instruments in its hollow interior for storage;

a web of material spirally wound on the spindle, the width of the web being somewhat less than the length of the housing, and the web being asymetically located between the ends of the spindle;

a pair of flanges associated with at least the first shell or second shell spaced apart longitudinally of the shell by a distance generally equal to the width of the web wound on the spindle and adapted to cage the web wound on the spindle therebetween for limiting the longitudinal movement of the spindle within the housing when the first and second shells are in cooperating relationship to form the housing;

an elongated notch formed in one longitudinal edge of one of the shells, the longitudinal edge of the elongated notch being recessed inwardly of the convex surface of the shell in which it is formed, when the shells are in concavely facing relationship one longitudinal edge of the other one of the shells lays in juxtaposition to the open side of the elongated notch and cooperates to define a slot having a length generally equal to the width of the web; and, a cap attached to the projecting end of the spindle so that the the spindle is rotatably movable with the cap, the cap is adapted to be removably attached to the spindle to open and close access to the hollow interior of the spindle.

2. The roll container of claim 1, further comprising:

hinge means interconnecting the first and second shells so that the shells can be pivoted relative to each other from a closed position forming the housing to an open position out of mutual concavely facing relationship.

3. The roll container of claim 1, wherein the first and second shells comprise means for journal mounting the end of the spindle located within the housing.

4. The roll container of claim 1, wherein at least one of the shells comprise means for supporting the spindle between its ends in concentric relationship to the longitudinal axes of the housing and for rotational movement about the longitudinal axes of the housing.

5. The roll container of claim 2, wherein the hinge means interconnects one longitudinal edge of the first shell and one longitudinal edge of the second shell.

6. The roll container of claim 5, wherein the hinge means is integral with the first and second shells.

7. The roll container of claim 1, wherein:

the second shell has open opposite ends; and, when the first and second shells are in mutually concavely facing relationship the circular end wall of the first shell closes one open end of the second shell, and the annular end wall of the first shell closes the other open end of the second shell.

8. The roll container of claim 3, wherein the journal mounting means comprises means defining an arcuate ledge associated with the first shell and means defining an arcuate ledge associated with the second shell.

9. The roll container of claim 1, further comprising latch means for selectively latching the shell halfs in the closed position concavely facing each other.

10. The roll container of claim 9, wherein the latch means comprises:

means defining a slit in one of the shell halfs; and, a lip associated with the other one of the shell halfs and adapted to be received in the slit.

11. The roll container of claim 1, wherein the diameter of the bore of the annular wall is generally equal to the diameter of the spindle.

12. The roll container of claim 1, wherein the cap comprises a circular collar having an outside diameter substantially equal to the inside diameter of the hollow spindle, the cap collar being adapted to be received through the open spindle end and frictionally engage the interior wall surface of the hollow spindle.

* * * * *